US007503558B2

(12) United States Patent
Kusumi

(10) Patent No.: US 7,503,558 B2
(45) Date of Patent: Mar. 17, 2009

(54) SHEET ELEVATION APPARATUS AND IMAGE FORMING APPARATUS USING THE SAME

(75) Inventor: Tadashi Kusumi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 345 days.

(21) Appl. No.: 11/442,298

(22) Filed: May 30, 2006

(65) Prior Publication Data

US 2007/0001380 A1 Jan. 4, 2007

(30) Foreign Application Priority Data

May 31, 2005 (JP) ..... 2005-160521

(51) Int. Cl.
*B65H 1/18* (2006.01)

(52) U.S. Cl. ..... 271/152; 271/153

(58) Field of Classification Search ..... 271/152, 271/153, 154

See application file for complete search history.

(56) References Cited

U.S. PATENT DOCUMENTS 5,343,450 A * 8/1994 Hamoda et al. ..... 369/19
6,161,829 A 12/2000 Kusumi

FOREIGN PATENT DOCUMENTS

JP 07061610 A * 3/1995
JP 09-086680 3/1997
JP 10-067446 3/1998
JP 11199075 A * 7/1999

* cited by examiner

*Primary Examiner*—Patrick H Mackey
*Assistant Examiner*—Michael C McCullough
(74) *Attorney, Agent, or Firm*—Harness, Dickey & Pierce, P.L.C.

(57) ABSTRACT

A sheet elevating apparatus for use in a sheet tray cassette detachably installable to an image forming apparatus includes an elevation driving source, a first coupling, an elevation member, a second coupling, and an elevation controller. The elevation driving source is mounted to the image forming apparatus. The first coupling is connected to the elevation driving source and has a home position. The elevation member elevates a plurality of recording sheets placed on an elevating base plate of the sheet tray cassette. The second coupling is connected to the elevation member and is engaged with the first coupling set at the home position when the sheet tray cassette is installed in the image forming apparatus. The elevation controller drives the elevation driving source to set the first coupling to the home position when the sheet tray cassette is pulled out.

5 Claims, 6 Drawing Sheets

SHEET ELEVATION APPARATUS AND IMAGE FORMING APPARATUS USING THE SAME

BACKGROUND

1. Field

This patent specification describes a sheet elevation apparatus for use in an image forming apparatus, and more particularly to a sheet elevation apparatus capable of being coupled to an image forming apparatus with a more easy-to-use manner. This patent specification further describes an image forming apparatus using the above-mentioned sheet elevation apparatus.

2. Discussion of the Background Art

Background image forming apparatuses such as copiers, facsimiles, and printers have been provided with a sheet supply box for containing a stock of recording sheets. A typical example of the sheet supply box is called a sheet tray cassette which is detachably mounted to an image forming apparatus. Some sheet tray cassettes include a sheet elevating mechanism for elevating a stock of recording sheets placed on a base plate upwardly in accordance with an amount of recording sheets remaining on the base plate. With this mechanism, an uppermost recording sheet of the stock of recording sheets placed on the base plate is kept at a predetermined position suitable for being picked up for a transportation to an image forming operation.

In responding to an increasing demand for a high-volume reproduction, a recent sheet tray cassette has a relatively large capacity and needs a relatively great driving power for elevation of the base plate. In addition, a so-called front-loading is a current mainstream of the sheet tray cassette, capable of being loaded into an image forming apparatus from a front position, that is, an operator's position. The front-loading sheet tray cassette is typically provided with a coupling to engage an elevator with a drive motor. When the sheet tray cassette is pulled out, the coupling disengages the elevator from the drive motor which is left in the apparatus.

In one example coupling mechanism, a joint which forms a coupling at the drive motor side is movable in an axis direction by a predetermined stroke and has an edge surface having a cross-shaped groove formed in a direction perpendicular to the axis. A counter member forming the coupling together with the joint has a top surface forming a cross-shaped pin. The cross-shaped pin of the counter member is inserted to the cross-shaped groove of the joint so that a power of the drive motor is transmitted.

The above-mentioned joint is pressed toward the counter member in the axis direction with a spring. The cross-shaped pin and the cross-shaped groove may not always conveniently be met with each other for an appropriate engagement during a loading of the sheet tray cassette into the image forming apparatus. When the cross-shaped pin and the cross-shaped groove are not properly met and are not engaged with each other, the counter member pushes the joint in a direction opposing the force of the spring. As the joint is moved in the direction opposing the force of the spring, a relative position of the joint and the counter member is gradually changed. When the relative position of the joint and the counter member is changed to an engagement position, the cross-shaped pin of the counter member is inserted into the cross-shaped groove of the joint. Thereby, an engagement of the coupling is achieved.

The background image forming apparatus is also provided with a pair of rails on which the sheet tray cassette is slid when it is loaded. Loading the sheet tray cassette is not so easy because of weights of recording sheets and the sheet tray cassette itself. Loading the sheet tray cassette also needs a counter power to oppose the force of the spring associated with the joint.

As such, elevating the base plate needs a relatively great power, and the coupling may easily be disengaged if the engagement of the coupling is insufficient. As a result, a the base plate falls down about a fulcrum. To address this problem, a solution may be to make the moving stroke of the joint and the force of the spring both greater. Accordingly, a more greater force for pushing the sheet tray cassette is needed.

In the above case, the sheet tray cassette continues to receive a force in a direction to be pushed out due to a reaction force generated by the spring until an engagement of the coupling is completed. That is, an extra holder may be needed for holding the sheet tray cassette against the reaction force.

SUMMARY

This patent specification describes a novel sheet elevating apparatus for use in a sheet tray cassette detachably installable to an image forming apparatus. In one example, a novel sheet elevating apparatus includes an elevation driving source, a first coupling, an elevation member, a second coupling, and an elevation controller. The elevation driving source is mounted to the image forming apparatus. The first coupling is connected to the elevation driving source and has a home position. The elevation member is configured to elevate a plurality of recording sheets placed on an elevating base plate of the sheet tray cassette. The second coupling is connected to the elevation member and is configured to be engaged with the first coupling set at the home position when the sheet tray cassette is installed in the image forming apparatus. The elevation controller is configured to drive the elevation driving source to set the first coupling to the home position when the sheet tray cassette is pulled out.

This patent specification further describes a novel image forming apparatus with an improved superior sheet elevating mechanism. In one example, a novel image forming apparatus includes an image forming mechanism and a sheet tray cassette. The image forming mechanism is configured to form an image. The sheet tray cassette includes an elevating base plate and a sheet elevating device. On the elevating base plate, a plurality of recording sheet are placed, and the plurality of recording sheets are picked up sheet by sheet and are transported to the image forming mechanism to receive the image thereon. The sheet elevating device has an elevation driving source, a first coupling, an elevation member, a second coupling, and an elevation controller. The elevation driving source is mounted to the image forming apparatus. The first coupling is connected to the elevation driving source and has a home position. The elevation member is configured to elevate the elevating base plate of the sheet tray cassette to lift the plurality of recording sheets placed thereon. The second coupling is connected to the elevation member and is configured to be engaged with the first coupling set at the home position when the sheet tray cassette is installed in the image forming apparatus. The elevation controller is configured to drive the elevation driving source to set the first coupling to the home position when the sheet tray cassette is pulled out.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EMBODIMENTS

Figure 1:
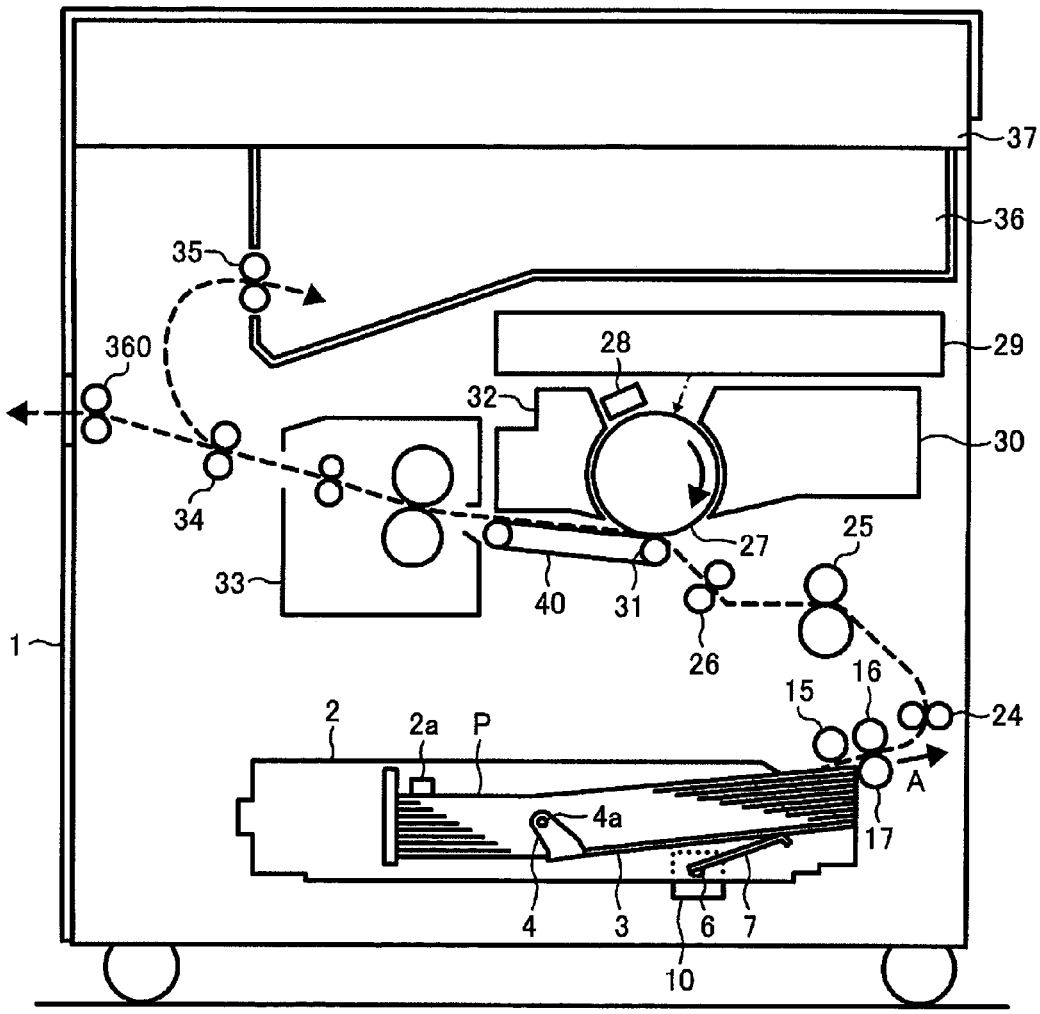
FIG. 1 is an illustration of an image forming apparatus according an example embodiment.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 1 according to an example embodiment of the present invention is described.

As illustrated in FIG. 1, the image forming apparatus 1 includes a sheet tray cassette 2, an elevation motor unit 10, a pick-up roller 15, a transport roller 16, a reverse roller 17, pairs of rollers 24 and 25, and a pair of registration rollers 26. The image forming apparatus 1 further includes a photosensitive drum 27, a charging unit 28, an optical writing unit 29, a development unit 30, a transfer roller 31, a cleaning unit 32, a fixing unit 33, a pair of transport rollers 34, a pair of face-up ejection rollers 35, a waist level ejection tray 36, an image reading unit 37, a transportation belt 40, and a pair of straight ejection rollers 360.

As illustrated in FIG. 1, the image forming apparatus 1 has a vertical structure in which the image reading unit 37, the waist level ejection tray 36, an image forming mechanism centered with the photosensitive drum 27, and a sheet supply mechanism centered with the sheet tray cassette 2 are, in this order, vertically mounted.

In the image forming mechanism, the photosensitive drum 27 is surrounded by a variety of process components according to manners of an electrostatic recording method, including the charging unit 28, the optical writing unit 29, the development unit 30, the transfer roller 31, and the cleaning unit 32.

The photosensitive drum 27 has a cylindrical, rotary, photosensitive surface. The charging unit 28 charges this photosensitive surface while the photosensitive drum 27 is rotated. The optical writing unit 29 generates exposure light and irradiates the charge surface of the photosensitive drum 27 with the exposure light. The optical writing unit 29 extends the exposure light within a predetermined imaging area on the photosensitive surface of the photosensitive drum 27 according to an original image read by the image reading unit 37. As a result of exposure, an electrostatic latent image is formed on the photosensitive surface of the photosensitive drum 27. The thus-formed electrostatic latent image is brought forward as the photosensitive drum 27 is rotated, and is visualized with toner by the development unit 30 when passing by a development area formed by the development unit 30. A resultant image after development is referred to as a toner image. The photosensitive drum 27 is further rotated and the toner image is brought to a transfer point where the toner image meets with a recording sheet P and is transferred onto the recording sheet P by the transfer roller 31. This image transfer is caused by an action of a transfer bias voltage applied to the transfer roller 31. The recording sheet P is transported from the sheet tray cassette 2 and is stopped by the pair of registration rollers 26. Driving the pair of registration rollers 26 is in synchronism with timing data from the optical writing unit 29, and the pair of registration rollers 26 are restarted to driven so that the recording sheet P is transported to the transfer point in synchronism with the rotation of the toner image carried on the photosensitive drum 27. At the transfer point, the toner image is transferred onto the recording sheet P by the transfer bias voltage applied to the transfer roller 31.

The transfer roller 31 is also used as a supporting roller of the transportation belt 40. After the transfer process described above, the recording sheet P having the toner image thereon is further transported by the rotation of the transportation belt 40 and is subjected to a fixing process when passing through the fixing unit 33. The recording sheet P after exiting the fixing unit 33 is further transported in a course of either a straight ejection or a face-up ejection via a branch pawl (not shown) provided in the vicinity of the pair of transport rollers 34. In the straight ejection, the recording sheet P is further transported and is then ejected by the pair of straight ejection rollers 360 to an external tray unit (not shown) or a finishing unit (not shown). In the face-up ejection, the recording sheet P is further transported upwardly and is then ejected by the pair of face-up ejection rollers 35 into the waist level ejection tray 36.

The sheet supply mechanism centered with the sheet tray cassette 2 is explained in details below with reference to FIGS. 1 and 2. The sheet supply mechanism is provided with various components, other than the sheet tray cassette 2, the pick-up roller 15, the transport roller 16, the reverse roller 17, and the pairs of rollers 24 and 25, as illustrated in FIG. 1.

Figure 2:
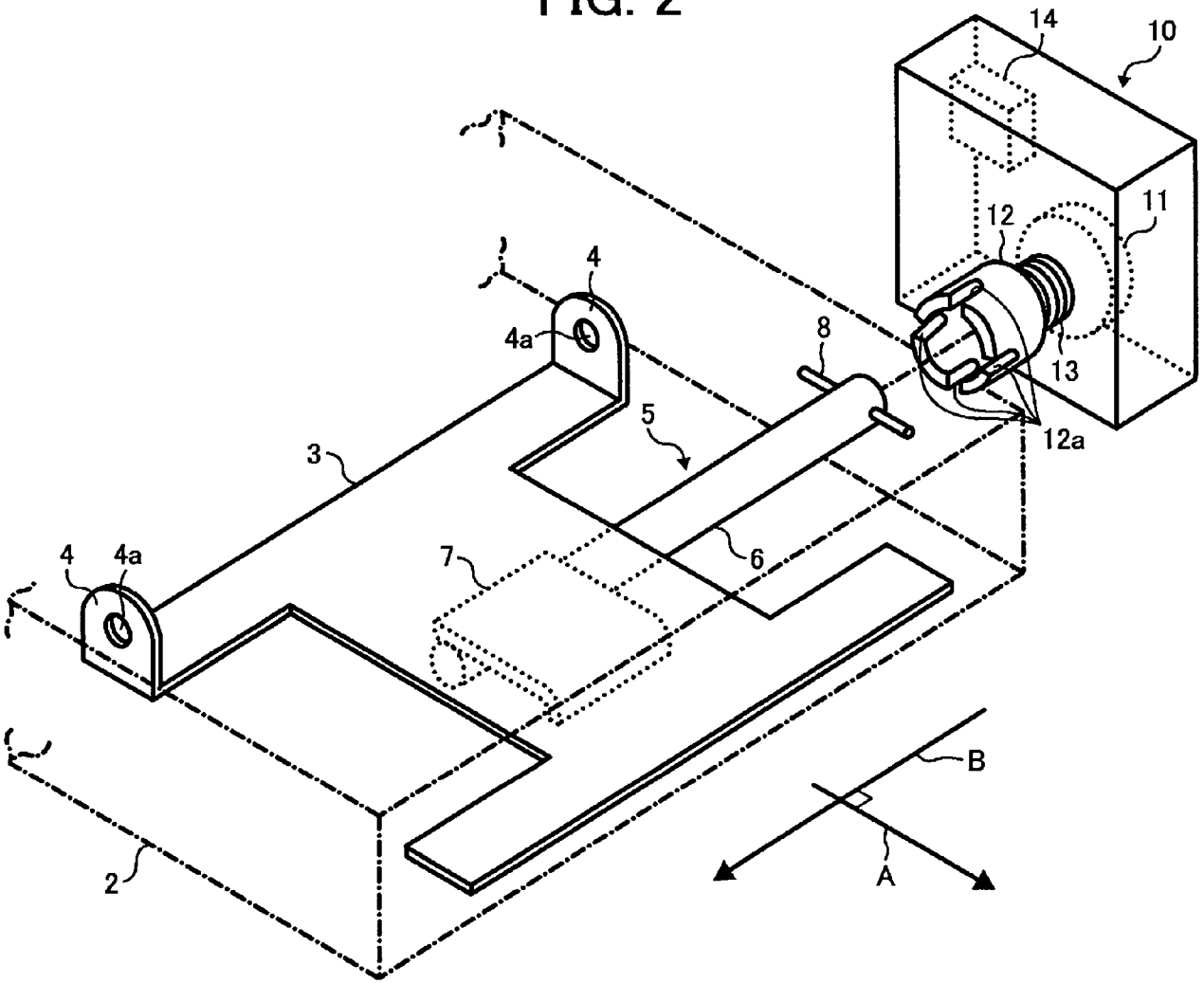
FIG. 2 is an illustration of a sheet elevation device of the image forming apparatus illustrated in FIG. 1.

As illustrated in FIG. 2, the sheet tray cassette 2 includes, an uppermost sheet detector 2*a*, a base plate 3 (also see FIG. 1) and an elevation member 5. The uppermost sheet detector 2*a* is mounted inside the sheet tray cassette 2 at a predetermined detection height and is configured to generate a signal when detecting an uppermost recording sheet P which reaches the predetermined detection height while being upwardly elevated. The base plate 3 includes two vertical tabs 4 having holes 4*a* (see also FIG. 1). The elevation member 5 includes a rotary shaft 6 (see also FIG. 1), an eccentric rotary plate 7 (see also FIG. 1), and two pins 8.

As a number of the recording sheets P are fed out from the sheet tray cassette 2, the number of the recording sheets P placed on the base plate 3 is reduced. Consequently, the eccentric rotary plate 7 is driven to have a steeper angle relative to a horizontal plane so as to lift the base plate 3 to maintain the uppermost recording sheet P on the base plate 3 at the predetermined level, that is, the predetermined detection height of the uppermost sheet detector 2*a*.

In the transportation of the recording sheet P from the sheet tray cassette 2, the pick-up roller 15 is driven to rotate. By rotation of the pick-up roller 15, the uppermost recording sheet P is separated from other remaining recording sheets P contained in the sheet tray cassette 2 and is transferred to the transport roller 16 and the reverse roller 17. The transport roller 16 further transports the uppermost recording sheet P, and the reverse roller 17 reversely transports any additional recording sheets P erroneously adhered to and carried together with the uppermost recording sheet P. Such erroneous adhesion of sheets to another sheet is caused due to a static electricity. If this reverse roller 17 is not provided, multiple sheets will be transported at a time, which is referred to as a multiple-sheet-feed error.

The recording sheet P correctly singularly transported by the transport roller 16 towards the pair of registration rollers 26 via the pairs of rollers 24 and 25. The recording sheet P is stopped by colliding with the pair of registration rollers 26 which are in a stop mode. The pair of registration rollers 26 are controllable to be turned on and off so as to synchronize timing of the recording sheet P with timing of the toner image carried on the photosensitive drum 27. In addition, stopping the recording sheet P by the pair of registration rollers 26 correct a skew of the recording sheet P.

In the sheet tray cassette 2, the base plate 3 is mounted at a bottom section and is held for rotation with a base shaft (not shown) which is arranged to pass through the holes 4*a* and is supported by walls (not shown) of the sheet tray cassette 2. The base plate 3 has an upper surface extended in a direction A (see also FIG. 1) and in a direction B perpendicular to the direction A, on which a number of the recording sheets P are placed. The base plate 3 is rotatable about the base shaft (not shown) in a direction perpendicular to the directions A and B (i.e., a vertical direction in FIG. 1).

The elevation member 5 is mounted under the base plate 3. The rotary shaft 6 of the elevation member 5 is held in parallel to the base shaft of the base plate 3 by the wall of the sheet tray cassette 2. The rotary shaft 6 has a predetermined length such that one end thereof is positioned under a middle part of the base plate 3. The eccentric rotary plate 7 has one end side which is fixedly attached to the one end of the rotary shaft 6 so as to be positioned under the middle part of the base plate 3, as illustrated in FIG. 2. The rotary shaft 6 has another end on which the two pins 8 are fixed in a manner such that the pins 8 are radially projected, as illustrated in FIG. 2.

When the rotary shaft 6 is rotated about a central axis thereof, the eccentric rotary plate 7 is also rotated about the central axis of the rotary shaft 6 such that a free end side of the eccentric rotary plate 7 is either lifted or lowered. When the rotary shaft 6 is rotated in one way (e.g., an anticlockwise), the eccentric rotary plate 7 is rotated and the free end side of the eccentric rotary plate 7 is lifted so as to push upwards the base plate 3. Thereby, the base plate 3 is rotated about the base shaft such that a free end side of the base plate 3 is lifted.

The elevation member 5 is driven by the elevation motor unit 10. As illustrated in FIG. 2, the elevation motor unit 10 includes an elevation motor 11, a coupling 12, a spring 13, and a tray controller 14. The tray controller 14 may also be referred to as an elevation controller. The elevation motor 11 has a motor shaft extended in the direction B, to which the spring 13 and the coupling 12 are connected such that the coupling 12 is slidable by a predetermined stroke along the motor shaft and is constantly pushed outward by the spring 13. There is a stopper (not shown) which stops a further outward movement of the coupling 12. The coupling 12 has a cylindrical wall having a hollow and evenly spaced slits 12*a* in the wall, as illustrated in FIG. 2. The tray controller 14 includes electrical components to control the elevation motor 11 by communicating with the uppermost sheet detector and a main electrical unit (not shown) of the image forming apparatus 1 for controlling an entire operations of the image forming apparatus.

When the sheet tray cassette 2 is loaded into the image forming apparatus 1, the rotary shaft 6 of the elevation member 5 is inserted into the hollow of the coupling 12. The pins 8 of the rotary shaft 6 which serve as a coupling at a side of the sheet tray cassette 2 are to be inserted into the slits 12*a*. When the pins 8 are inserted into the slits 12*a*, the coupling is engaged and the power transmission from the elevation motor 11 to the rotary shaft 6 is made possible via the coupling. However, When the pins 8 are not inserted and collide with edges of the cylindrical wall between the slits 12*a*, as the sheet tray cassette 2 is further inserted, the pins 8 pushes the coupling 12 against the force of the spring 13 to a predetermined position. Then, a relative position of the pins 8 and the coupling 12 is changed to a position where the pins 8 can enter the slits 12*a*. Thus, the coupling 12 is blown off outwardly by the force of the spring 13 and the pins 8 are inserted into the slits 12*a*. As a result, the coupling is engaged and the power transmission from the elevation motor 11 to the rotary shaft 6 is made possible via the coupling.

Under the condition that the coupling is thus engaged, the elevation member 5 is rotated as the elevation motor 11 is driven. An amount of rotation of the elevation member 5 corresponds to an amount of vertical lift of the uppermost recording sheet P on the base plate 3 which is detected by the uppermost sheet detector. Depending upon a number of recording sheets P on the base plate, the amount of vertical lift of the uppermost recording sheet P corresponds to the amount of rotation of the elevation member 5 in a range of from approximately 5 degrees to approximately 70 degrees. When the sheet tray cassette 2 is pulled out along a pair of guide rails (not shown) in the direction B, the pins 8 of the rotary shaft 6 is disengaged from the slits 12*a* of the coupling 12. As a result, the base plate 3 drops down due to a self-weight and a weight of the recording sheets P, if any, remaining on the base plate 3.

As described above, the base plate 3 is lowered when the sheet tray cassette 2 is pulled out. More specifically, the base plate 3 is stopped to be lowered when it collide with a bottom of the sheet tray cassette 2. The two pins 8 of the rotary shaft 6 are previously arranged to be approximately horizontal at this time, which position is referred to as a pin's home position.

On the other hand, the coupling 12 of the elevation motor unit 10 is set to a home position when the sheet tray cassette 2 is pulled out and the coupling 12 is disengaged from the pins 8 of the rotary shaft 6 of the sheet tray cassette 2. The home position of the coupling 12 is such that one of pairs of two opposite ones of the slits 12*a* is horizontal. When the sheet tray cassette 2 is pulled out, the slits 12*a* may not be at the home position. Therefore, when the sheet tray cassette 2 is pulled out, the elevation motor 11 is driven to an extent such that the coupling 12 is set to the home position.

With the above arrangements, the pins 8 of the rotary shaft 6 and the coupling 12 of the elevation motor unit 10 are set to the respective home positions when the coupling is disengaged. Therefore, when the sheet tray cassette 2 is reloaded to the image forming apparatus 1, the coupling is made in an easy and smooth manner.

Whether the slits 12*a* are at the home position or not is detected by using a coupling slit detector (not shown), for example. The elevation motor 11 is driven when the coupling is disengaged to adjust the position of the slits 12*a* and is stopped when receiving a home position detection signal from the coupling slit detector, thereby setting the slits 12*a* at the home position.

The home position of the slits 12*a* is not limited to the horizontal arrangement but it may possibly be at any angle as long as the arrangement of the two pins 8 is changed to fit to such an angle.

With the above arrangement, the pins 8 are easily and smoothly inserted into the slits 12*a* and therefore an extra force to push the coupling 12 against the spring 13 may no longer be needed. In addition, an associated supporting member such as a rotary catch for holding the pins 8 at the engagement position may be set to a weaker holding force. Therefore, the operator needs a less energy when loading or unloading the sheet tray cassette 2 to or from the image forming apparatus 1. In this case, since the pins 8 and the slits 12*a* may constantly fit to each other, the spring 13 may not necessarily be needed.

This exemplary embodiment indicates a warning that the sheet tray cassette 2 is pulled out and the coupling 12 is currently being rotated to set the slits 12*a* to the home position. This indication warns the operator not to load the sheet tray cassette 2 into the image forming apparatus 1 to avoid an unexpected damage to the components associated with the coupling, while the coupling 2 is being out of the home position.

Figure 3:
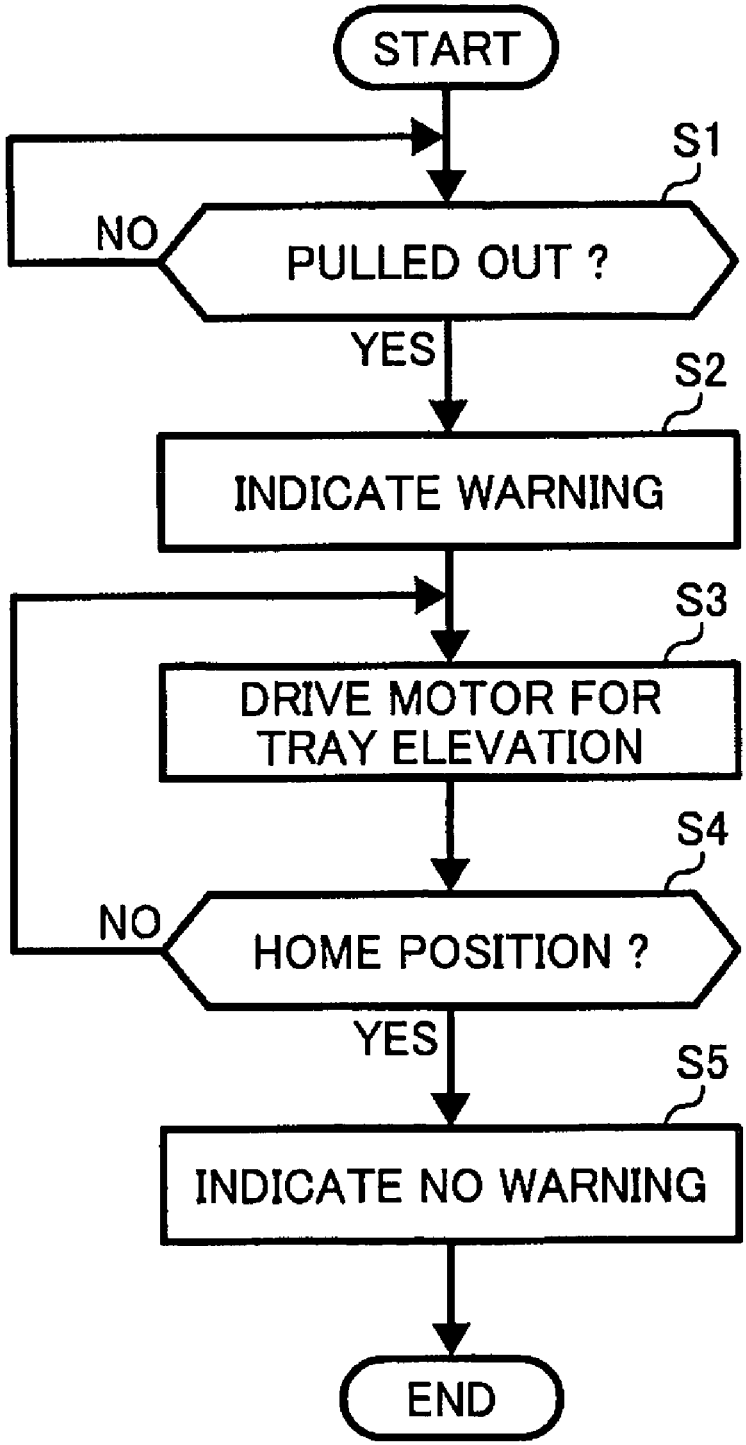
FIG. 3 is a flowchart of an example procedure of a warning indication conducted by the sheet elevation device of FIG. 2.

Referring to FIG. 3, an exemplary procedure of the warning indication described above is explained. In this procedure, the sheet tray cassette 2 initially is set in an operable position in the image forming apparatus 1, that is, the pins 8 of the rotary shaft 6 is engaged with the slits 12*a* of the coupling 12. Then, in Step S1, the tray controller 14 determines as to a status of the sheet tray cassette 2, whether the sheet tray cassette 2 is pulled out from the image forming apparatus 1. This determination step by the tray controller 14 continues to check the status of the sheet tray cassette 2 until the sheet tray cassette 2 is disengaged from the image forming apparatus 1. When the sheet tray cassette 2 is disengaged from the image forming apparatus 1 and the determination result of Step S1 is YES, the procedure proceeds to Step S2 and the tray controller 14 generates a signal for indicating a warning that the slits 12*a* of the coupling 12 are currently out of the home position, for example. The warning may indicate a message for prohibiting a reload of the sheet tray cassette until the status becomes ready. Then, in Step S3, the tray controller 14 drives the elevation motor 11 to rotate the coupling 12 to set the slits 12*a* to the home position. Then, in Step S4, the tray controller 14 determines as to a status of the slits 12*a*, whether the slits 12*a* are set to the home position, based on the home position detection signal from the coupling slit detector. As a result of this determination, when the slits 12*a* are determined as not set to the home position and the determination result is NO, the tray controller 14 returns to the process of Step S3 to repeat the driving of the elevation motor 11. When the slits 12*a* are determined as set to the home position and the determination result is YES, the tray controller 14 proceeds to Step S5 and terminates the indication of warning. Then, the procedure ends.

The above-described exemplary procedure can effectively prevent an erroneous loading of the sheet tray cassette 2 into the image forming apparatus 1 while the coupling 12 is rotated. Thereby, it becomes possible to avoid an unexpected damage which may be caused to the components associated with the coupling between the sheet tray cassette 2 and the elevation motor unit 10.

Figure 4:
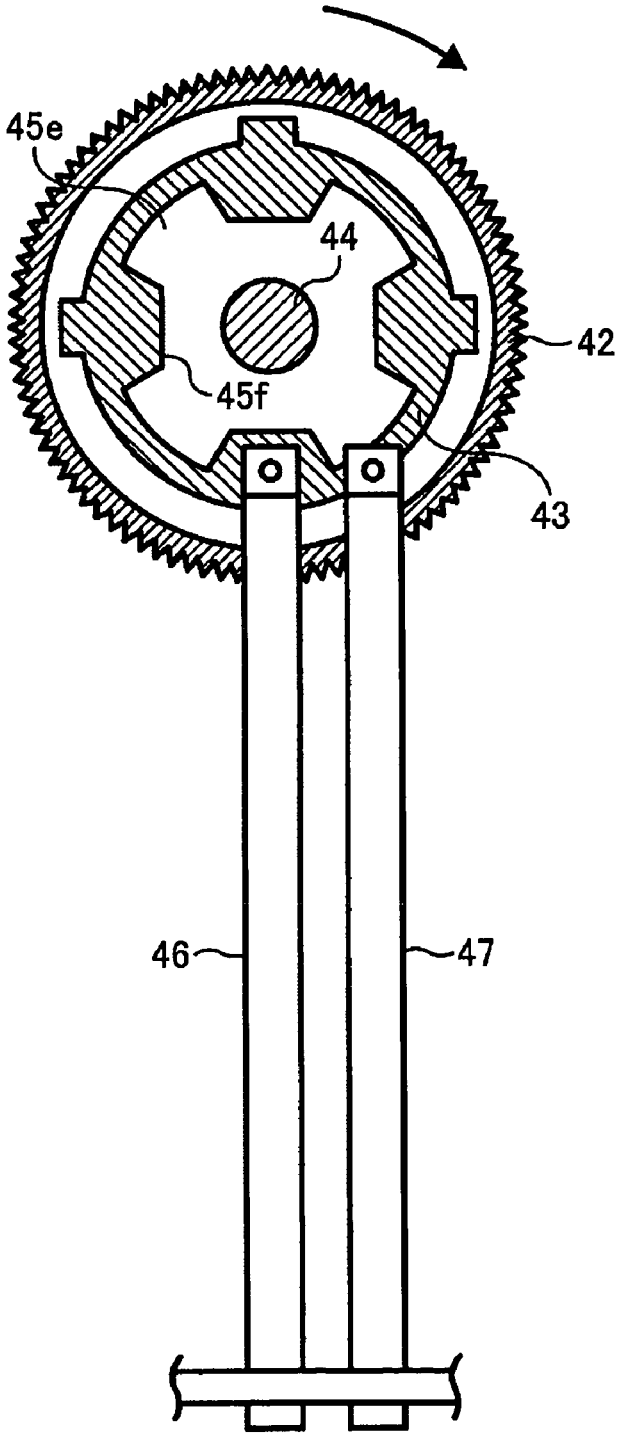
FIG. 4 is an illustration of an example remaining sheet detecting mechanism included in the sheet elevation device of FIG. 2.

Referring to FIG. 4, another exemplary embodiment is explained. This embodiment uses a remaining sheet detection mechanism for detecting an amount of the recording sheets P remaining on the base plate 3 of the sheet tray cassette 2. This embodiment can automatically select a shorter course of rotation of the coupling 12 to set the slits 12*a* back to the home position in accordance with an remaining amount of the recording sheets P detected by the remaining sheet detecting mechanism.

This remaining sheet detecting mechanism is linked with the rotation of the elevation motor 11 via a gear system (not shown). As illustrated in FIG. 4, the remaining sheet detecting mechanism includes a gear 42, a cam plate 43, a rotation shaft 44, and two contact plates 46 and 47. The gear 42 and the cam plate 43 are concentric and are rotated on the rotation shaft 44 in an integrated manner. The cam plate 43 internally includes four hollow portions 45*e* and projection portions 45*f* which are arranged to be evenly spaced, as illustrated in FIG. 4. The contact plate 46 contacts the cam plate 43 when the cam plate 43 is rotated and the projection portion 45*f* comes to a position in contact with the contact plate 46, while the contact plate 47 continuously contacts the cam plate 43. Accordingly, when the projection portion 45*f* comes to a position in contact with the contact plate 46, the contact plate 46 and the contact plate 47 are in a state of contact.

With the above-described structure, the contact plate 46 contacts the projection portions 45*f* periodically on and off as the cam plate 43 is rotated. This periodic contact generates a pulse signal. The tray controller 14 counts this pulse signal.

When the elevation motor 11 is driven, the rotation is transmitted to the rotary shaft 6 via the coupling 12 and accordingly the base plate 3 is lifted. Then, the uppermost recording sheet P is detected by the uppermost sheet detector 2*a*, and the elevation motor 11 is stopped based on the detection of the uppermost recording sheet P. During this operation, the tray controller 14 counts the pulse signal received from the remaining sheet detecting mechanism via the contact plate 46, and calculates a remaining amount of the recording sheets P remaining on the base plate 3 based on the counted pulse signal.

A rotation angle of the coupling 12 is in proportion to the number of revolution of the gear 42. Therefore, it is preferable to prepare and store a data table beforehand in the tray controller 14, containing relationship between the number of revolution of the cam plate 43 (i.e., the number of pulse signals), a swing angle of the eccentric rotary plate 7, and the number of recording sheets P placed on the base plate 3. With the data table, the tray controller 14 can easily calculate the number of recording sheets P remaining on the base plate 3 and the rotation angle of the coupling 12 at a condition that the elevation motor 11 is stopped.

That is, the tray controller 14 determines a smaller angle passage for the slits 12*a* to the home position by calculating clockwise and counterclockwise angles of the slits 12*a* to the home position in accordance with an remaining amount of the recording sheets P detected by the remaining sheet detecting mechanism. Then, the tray controller 14 drives the elevation motor 11 to rotate the coupling 12 to set the slits 12*a* to the home position in a direction of the smaller angle passage. Thus, a time period for the image forming apparatus 1 to be in a not-ready status is minimized.

Figure 5:
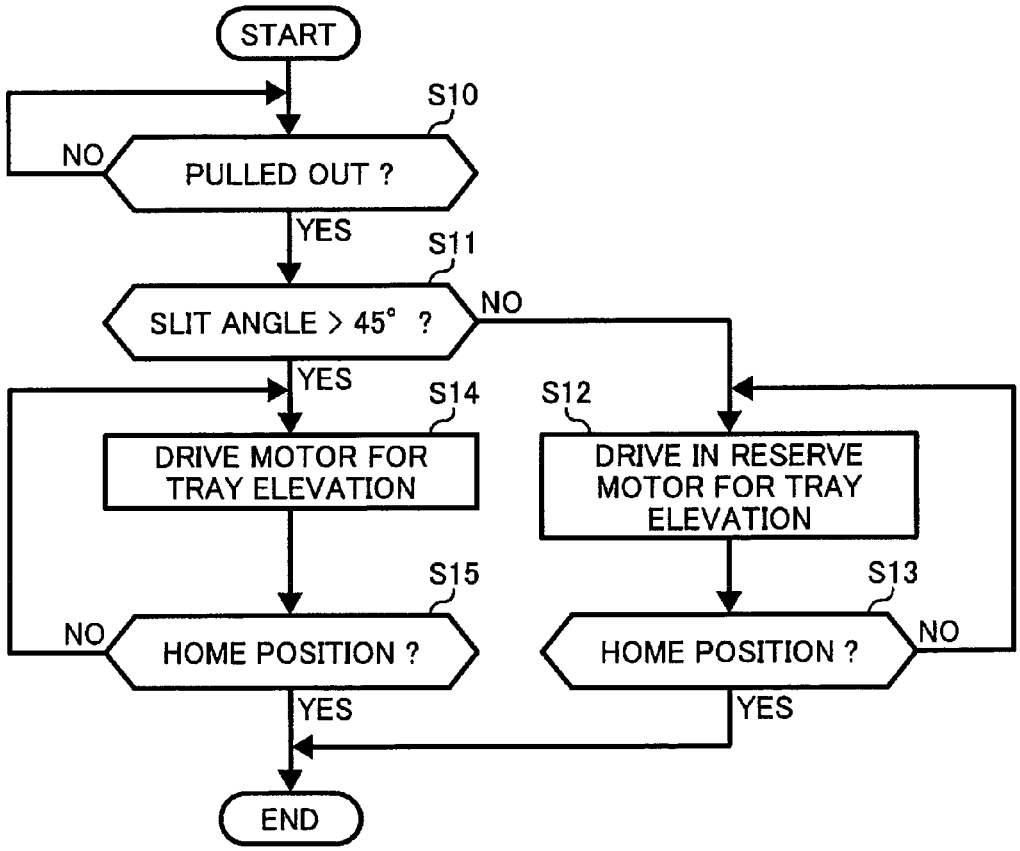
FIG. 5 is a flowchart of an example procedure for quickly returning a coupling to a home position.

Referring to FIG. 5, an exemplary procedure of controlling the elevation motor 11 is explained. In Step S10 of FIG. 5, the tray controller 14 determines as to a status of the sheet tray cassette 2, whether the sheet tray cassette 2 is pulled out from the image forming apparatus 1. This determination step by the tray controller 14 continues to check the status of the sheet tray cassette 2 until the sheet tray cassette 2 is disengaged from the image forming apparatus 1. When the sheet tray cassette 2 is disengaged from the image forming apparatus 1 and the determination result of Step S10 is YES, the procedure proceeds to Step S11 and the tray controller 14 determines as to whether a current angle of the slits 12*a* is greater than 45 degrees relative to the horizontal plane, that is, an angle of the home position. At this time, the tray controller 14 refers the current angle of the slits 12*a* to the data table indicating a relationship between the current angle of the slits 12*a* and the remaining amount of the recording sheets P.

When the current angle of the slits 12*a* is determined as not greater than 45 degrees and the determination result of Step S11 is NO, the tray controller 14 proceeds to Step S12 and drives the elevation motor 11 to rotate the coupling 12 in a direction to decrease the current angle to 0 degrees so as to set the slits 12*a* to the home position. Then, in Step S13, the tray controller 14 determines as to whether the slits 12*a* are in the home position by using the coupling slit detector (not shown). When the slits 12*a* are determined as not in the home position, the tray controller 14 returns the process to Step S12 to repeat the driving of the elevation motor 11. When the slits 12*a* are determined as in the home position, the tray controller 14 ends the controlling procedure of the elevation motor 11.

On the other hand, when the current angle of the slits 12*a* is determined as greater than 45 degrees and the determination result of Step S11 is YES, the tray controller 14 proceeds to Step S15 and drives the elevation motor 11 to rotate the coupling 12 in a direction to increase the current angle to 90 degrees so as to set the slits 12*a* to the home position. Then, in Step S15, the tray controller 14 determines as to whether the slits 12*a* are in the home position by using the coupling slit detector. When the slits 12*a* are determined as not in the home position, the tray controller 14 returns the process to Step S14 to repeat the driving of the elevation motor 11. When the slits 12*a* are determined as in the home position, the tray controller 14 ends the controlling procedure of the elevation motor 11.

Thus, the image forming apparatus 1 can minimize a time period in a not-ready status when the sheet tray cassette 2 is pulled out.

As described above, the amount of rotation of the elevation member 5 is in a range of from approximately 5 degrees to approximately 70 degrees. Since the coupling 12 has the four slits 12*a* evenly spaced with 90 degrees, the slits 12*a* can be settled at the home position by every rotation of 90 degrees. Therefore, the above determination step compares the current angle of the slits 12*a* with a half angle of 90 degrees, that is, 45 degrees.

There is an alternative. The above-described remaining sheet detection mechanism referring to FIG. 4 for detecting an amount of the recording sheets P remaining on the base plate 3 of the sheet tray cassette 2 outputs a stepwise detection of the remaining recoding sheets. For each step of detection, the tray controller 14 can previously calculates and store in a memory a corresponding range of angle of the slits 12*a*. Therefore, it is possible to determine a rotation direction of the elevation motor 11 in accordance with a status whether a half of the corresponding range of angle of the slits 12*a* applicable to each detection step of the remaining recording sheet is greater than 45 degrees or not.

Next, another exemplary embodiment is explained. This embodiment prevents a damage to components associated with the coupling 12 even when the sheet tray cassette 2 is slowly pulled out and is then reloaded. In this embodiment, the image forming apparatus 1 is provided with a push switch (not shown) for detecting an insertion of the sheet ray cassette 2 when the sheet tray cassette 2 is loaded into the image forming apparatus 1 and pushes the push switch.

When the sheet tray cassette 2 is completely pulled out at one stroke, timing of releasing the push switch is nearly equal to timing of disengagement of the pins 8 from the slits 12*a* of the coupling 2. However, when the sheet tray cassette 2 is slowly pulled out, there may be a case in which the tray controller 14 recognizes the sheet tray cassette is pulled out based on the status of the push switch while the pins 8 are not disengaged from the slits 12*a* of the coupling 2. In this situation, if the tray controller 14 drives the elevation motor 11 to rotate the coupling 12 to set the slits 12*a* to the home position, the elevation member 5 may excessively be lifted to cause the uppermost recording sheet P to collide with the pick-up roller 15, for example, to a damage.

This exemplary embodiment puts a higher priority to the detection of the uppermost recording sheet P by the uppermost sheet detector 2*a* than the signal of indicating a release of the push switch. That is, even when the tray controller 14 recognizes the sheet tray cassette is pulled out based on the status of the push switch, the tray controller 14 stops sending the instruction to the elevation motor 11 to rotate the coupling 12 while the uppermost sheet detector 2*a* is properly detecting an existence of the uppermost recording sheet P at the predetermined detection height.

Figure 6:
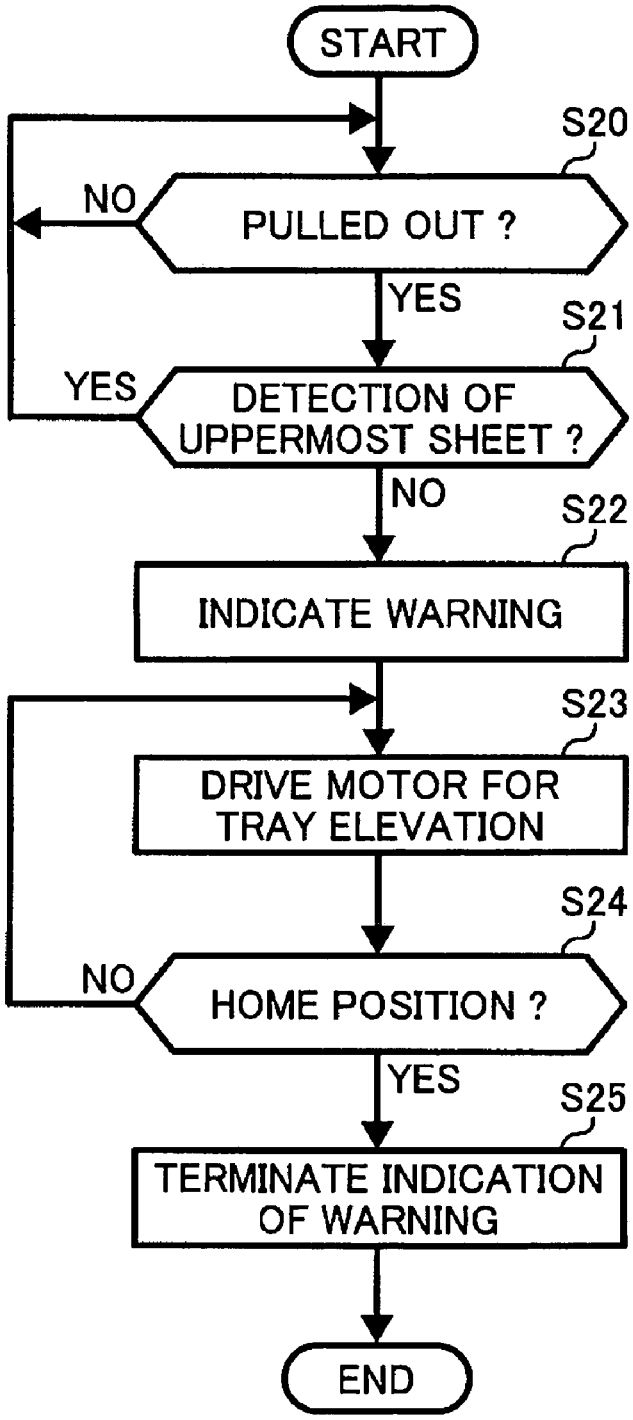
FIG. 6 is a flowchart of an example procedure for avoiding a damage by returning the coupling to the home position while the coupling is engaged.

Referring to FIG. 6, an exemplary procedure of the above-described operation is explained. In Step S20 of FIG. 6, the tray controller 14 determines as to a status of the sheet tray cassette 2, whether the sheet tray cassette 2 is pulled out from the image forming apparatus 1. This determination step by the tray controller 14 continues to check the status of the sheet tray cassette 2 until the sheet tray cassette 2 is disengaged from the image forming apparatus 1. When the sheet tray cassette 2 is disengaged from the image forming apparatus 1 and the determination result of Step S20 is YES, the procedure proceeds to Step S21 and the tray controller 14 determines as to whether the uppermost recording sheet P is at the predetermined detection height based on the detection by the uppermost sheet detector 2*a*. When the uppermost recording sheet P is determined as being at the predetermined detection height and the determination result of Step S21 is YES, the tray controller 14 returns the process to Step S20 to repeat the same procedure. That is, the tray controller 14 stops causing the elevation motor 11 to rotate the coupling 12 while the uppermost sheet detector 2*a* is detecting the uppermost recording sheet P at the predetermined detection height even when recognizing the sheet tray cassette is pulled out.

When the uppermost recording sheet P is determined as not being at the predetermined detection height and the determination result of Step S21 is NO, the tray controller 14 proceeds to Step S22 and indicates a warning that the sheet tray cassette 2 is pulled out and the coupling 12 is currently being rotated to set the slits 12*a* to the home position. Then, in Step S23, the tray controller 14 causes the elevation motor 11 to rotate the coupling 12 to set the slits 12*a* to the home position. After that, in Step S24, the tray controller 14 determines as to whether the slits 12*a* are set to the home position based on the detection by the coupling slit detector. This determination step is repeated until the slits 12*a* are determined as being at the home position. When the slits 12*a* are determined as being at the home position, the tray controller 14 proceeds to Step S25 and terminates the indication of warning. Then, the tray controller 14 ends the procedure.

Thus, this embodiment can prevent a damage to components associated with the coupling 12 in a case where the sheet tray cassette 2 is slightly pulled out and is then reloaded.

Techniques described in this patent specification may be conveniently implemented using a conventional general purpose digital computer programmed, as will be apparent to those skilled in the computer art. Appropriate software coding can readily be prepared by skilled programmers based on the techniques described in this patent specification, as will be apparent to those skilled in the software art. The techniques described in this patent specification may also be implemented by the preparation of application specific integrated circuits or by interconnecting an appropriate network of conventional component circuits, as will be readily apparent to those skilled in the art.

Numerous additional modifications and variations are possible in light of the above techniques. It is therefore to be understood that within the scope of the appended claims, the techniques described in this patent specification may be practiced otherwise than as specifically described herein.

This patent specification is based on Japanese patent application, No. JPAP2005-160521 filed on May 31, 2005 in the Japan Patent Office, the entire contents of which are incorporated by reference herein.

What is claimed is:

1. A sheet elevating apparatus for use in a sheet tray cassette detachably installable to an image forming apparatus, comprising:

an elevation driving source mounted to the image forming apparatus;

a first coupling connected to the elevation driving source and having a home position;

an elevation member configured to elevate a plurality of recording sheets placed on an elevating base plate of the sheet tray cassette;

a second coupling connected to the elevation member so as to engage with the first coupling set at the home position when the sheet tray cassette is installed in the image forming apparatus;

an elevation controller configured to drive the elevation driving source to set the first coupling to the home position when the sheet tray cassette is pulled out; and a remaining sheet detector configured to detect an amount of recording sheets remaining on the elevating base plate of the sheet tray cassette, wherein the elevation controller calculates rotation passages in clockwise and counterclockwise directions for the first coupling to return to the home position and drives the elevation driving source to set the first coupling in a shorter course of one of the rotation passages calculated to the home position in accordance with the amount of recording sheets detected by the remaining sheet detector before the sheet tray cassette is pulled out.

2. The sheet elevating apparatus of claim 1, wherein the home position of the first coupling is determined in accordance with an angle of rotation of the second coupling settled at a time when the elevation member is rotated at an event of unloading of the sheet tray cassette in which the sheet tray cassette is pulled out, the first and second couplings are disengaged from each other, and the elevating base plate of the sheet tray cassette is dropped to a bottom surface of the sheet tray cassette.

3. The sheet elevating apparatus of claim 1, further comprising:

a warning indication mechanism configured to generate a signal for indicating a warning that the sheet tray cassette is pulled out and that the first coupling is currently being rotated to be set to the home position.

4. The sheet elevating apparatus of claim 1, further comprising:

an uppermost sheet detector configured to detect an uppermost sheet placed on the elevating base plate at a predetermined detection height, wherein the elevation controller stops driving the elevation driving source to set the first coupling to the home position while the uppermost sheet detector detects the uppermost sheet at the predetermined detection height even when the sheet tray cassette is pulled out.

5. An image forming apparatus, comprising:

an image forming mechanism configured to form an image; and a sheet tray cassette including an elevating base plate on which a plurality of recording sheet are placed, the plurality of recording sheets being picked up sheet by sheet and transported to the image forming mechanism to receive the image thereon, and a sheet elevating device having an elevation driving source mounted to the image forming apparatus;

a first coupling connected to the elevation driving source and having a home position;

an elevation member configured to elevate the elevating base plate of the sheet tray cassette to lift the plurality of recording sheets placed thereon;

a second coupling connected to the elevation member so as to engage with the first coupling set at the home position when the sheet tray cassette is installed in the image forming apparatus;

an elevation controller configured to drive the elevation driving source to set the first coupling to the home position when the sheet tray cassette is pulled out; and a remaining sheet detector configured to detect an amount of recording sheets remaining on the elevating base plate of the sheet tray cassette, wherein the elevation controller calculates rotation passages in clockwise and counterclockwise directions for the first coupling to return to the home position and drives the elevation driving source to set the first coupling in a shorter course of one of the rotation passages calculated to the home position in accordance with the amount of recording sheets detected by the remaining sheet detector before the sheet tray cassette is pulled out.

* * * * *